United States Patent [19]

Plough et al.

[11] 4,316,492

[45] Feb. 23, 1982

[54] WALLET WITH BADGE HOLDER

[75] Inventors: Stephan E. Plough, 15805 Oak Valley Rd., Ramona, Calif. 92065; David L. Swartzendruber, Ramona, Calif.

[73] Assignee: Stephan E. Plough, Ramona, Calif.

[21] Appl. No.: 191,990

[22] Filed: Sep. 29, 1980

[51] Int. Cl.[3] ..... A45C 11/00

[52] U.S. Cl. ..... 150/35

[58] Field of Search ..... 150/35, 34, 39

[56] References Cited

U.S. PATENT DOCUMENTS 1,214,282 1/1917 Day ..... 150/34

1,944,345 1/1934 Hughes ..... 150/35

2,219,561 10/1940 Miller ..... 150/35 X 2,650,444 9/1953 Coyle et al. ..... 150/39 X

*Primary Examiner*—Donald F. Norton

*Attorney, Agent, or Firm*—Henri J. A. Charmasson

[57] ABSTRACT

A combination wallet and badge holder is provided the inside of which has a badge-mounting panel with a specially constructed badge covering flap thereover which conforms to the contours of the badge and both protects a vinyl I.D. window on the other side of the wallet from the abrasive nature of the badge and also conforms sufficiently closely to the contours of the face of the badge to enable the user to show his identification for purposes of cashing checks and the like without revealing the badge.

4 Claims, 6 Drawing Figures

WALLET WITH BADGE HOLDER

BACKGROUND

There are currently being made wallets for peace officers which have some provision for mounting the officer's badge inside the wallet. Some of these also have a cover flap to lie over the badge to protect the badge and keep it away from prying eyes when the wallet is opened. however, typically these prior art devices utilize felt badge covers or other single layer material which will rub through over a period of time and permit the surface of the badge to crack the transparent I.D. window.

Also, typically of prior badge holders the panel where the badge is mounted had no special provision for securing the badge other than permitting the badge pin to be jammed through it. Over a period of use, naturally the pin would tend to enlarge the holes it had pierced, giving the badge a sloppy feel in the wallet. Also, the small, light felt badge cover generally was inadequate to cover the badge, and the edges of the badge would be plainly visible when the wallet was opened.

SUMMARY

The present invention eliminates the above-stated problems by providing a specially designed combination wallet and badge holder having a badge-mounting panel with three metal eyelets therein to accept the pin of the badge so that the entire weight of the badge, which might be several ounces, is not borne by bare fabric on the thin shaft of the pin.

The badge covering flap is a specially constructed three-layer sandwich designed to mold itself to the shape of the badge over a period of time, thus covering the badge better and providing a better protection for the transparent vinyl I.D. cover on the opposite side of the wallet inside.

DETAILED DESCRIPTION OF THE PREFERRED EMBODIMENTS

Figure 1:
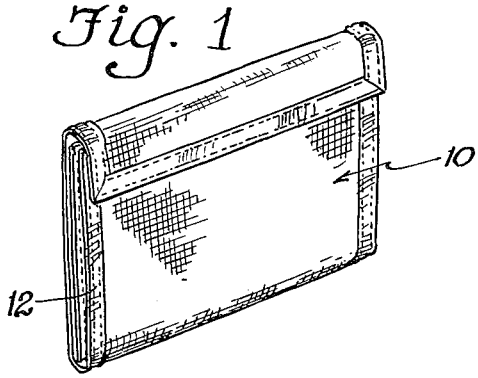
FIG. 1 is a perspective view of the wallet in closed mode.
Figure 2:
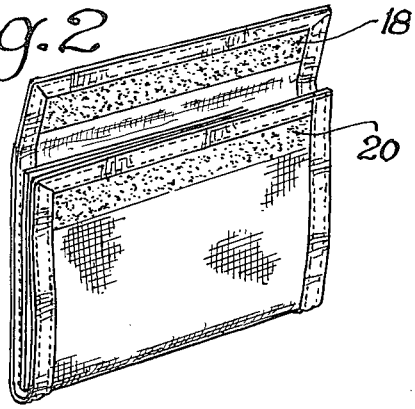
FIG. 2 is a perspective view similar to FIG. 1 with the latching flap pulled free.
Figure 3:
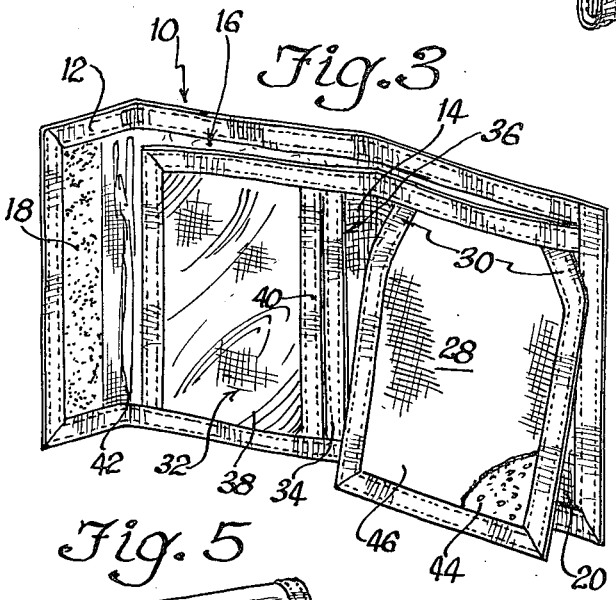
FIG. 3 is a perspective view of the wallet when opened revealing the inside.

The overall construction of the wallet can best be seen in FIG. 3 wherein a back panel 10 is double stitched around its entire periphery inside the peripheral hem 12 which also secures along the substantial length of the right and bottom lengths thereof a front panel 14, which is of somewhat smaller dimensions that the back panel and defines a bill pocket at 16. The inside of the left edge of the back flap 18 and the outside of the right edge of the back flap 20 have Velcro strips spanning the width of the back panel so the wallet will open and close as indicated in FIGS. 1 and 2.

Figure 4:
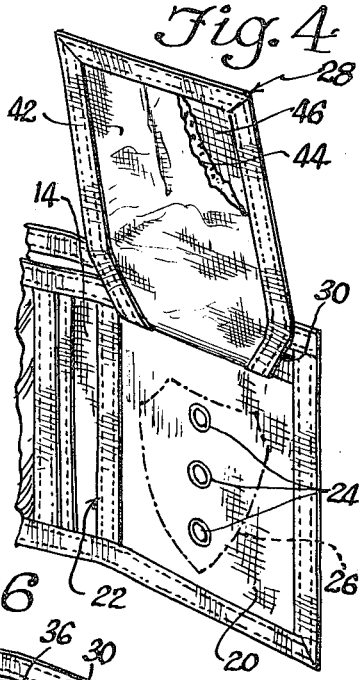
FIG. 4 is a perspective similar to FIG. 3 of the badge holding portion with the flap raised.

The right side of the front panel has stitched to it a badge-mounting panel 20, shown in FIG. 4, which is open on its left side seen in that figure to define another pocket for miscellaneous articles at 22. The badge-mounting panel itself has three aligned eyelets 24 to accommodate the pin of a badge, shown in outline at 26. These eyelets prevent wear and widening of the fabric of the badge-mounting panel with time.

Hemmed into the upper edge of the front panel right above the badge-mounting panel is a badge cover flap 28 which tapers inwardly at 30 to accommodate the vertical hems alongside the badge-mounting panel and, by reducing the length of the hinge line, reduce the stiffness of the hinge.

The opposite side of the front flap of the wallet defines two further pockets by means of two further panels, the first panel being a fabric panel 32 terminating in a hem 34 which is not stitched to the front panel 14 and therefore defines a pocket 36 behind it. That construction is substantially duplicated by a transparent vinyl panel 38 having a hem at 40 and defining an I.D. pocket 42 underneath the hem.

Rather than having a transparency insert to cover I.D. over the pocket 36, the vinyl panel 38 is stitched into position. It is therefore important, since it is not replaceable easily, that the badge cover flap 28 be adequate to protect it from abrasion from the badge over a period of time. To this end the badge flap is made of a three layer construction, as is the back panel 10. The innermost layer which contacts the badge is tafeta, shown at 42 in FIGS. 3 and 4. The tafeta is backed by a thin layer of soft foam 44 that is actually bonded to the back of the tafeta, and behind the foam is a grade of tough nylon cloth 46.

In use, the flap 28 will conform substantially to the contours of the front of the badge. Because this flap is so wide, due to the way in which it expands from the hinge line, it does a good job of covering the badge and once it wears to follow the contours of the badge, permits the officer to open his wallet without revealing that he is in fact a peace officer.

Figure 5:
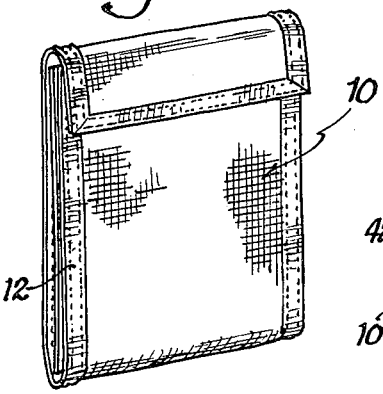
FIG. 5 is a perspective view of a slight modification of the wallet.
Figure 6:
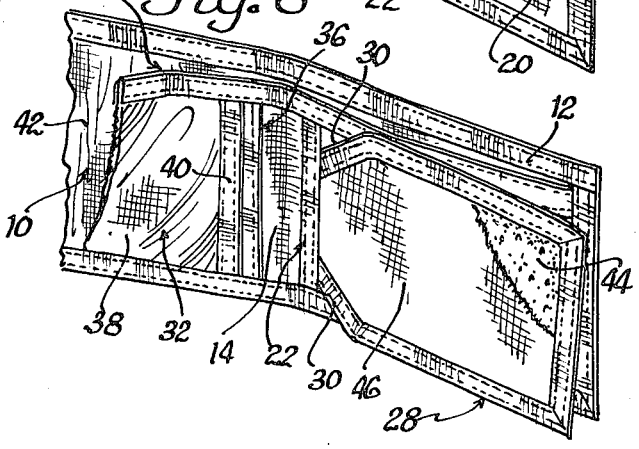
FIG. 6 is a perspective view of a portion of the interior of the modification shown in FIG. 5.

The wallet shown in FIGS. 5 and 6 is identical in construction to the first embodiment except that the long dimension of the badge-mounting portion and the I.D. pocket are aligned rather than being parallel.

Thus the combination wallet and badge holder of the instant invention is durable, economical, and particularly tailored to the needs of peace officers. The nylon material used is preferably a slightly coarse, tough weave such as is marketed under the trademark CORDURA, so that it does not slip out of the rear pocket. However, the flexible nature of the wallet-badge holder is such that it will not wear out pants pockets, and the badge is not permitted to crack or scuff the transparent I.D. cover.

What is claimed is:

1. A combination wallet and badge holder comprising:

(a) a generally rectangular flexible back panel;

(b) a flexible front panel fastened to said back panel along at least two contiguous edges thereof to define a bill compartment;

(c) a badge-mounting panel mounted to at least one of the above stated panels;

(d) a badge cover flap mounted to at least one of the abovementioned panels to removably protect and conceal a badge mounted on said badge-mounting panel, and (e) said flap having a taffeta badge-contacting surface and a layer of soft foam bonded to the side thereof remote from said badge-mounting panel, said taffeta and foam being capable of deforming to define a shaped mask for a badge.

2. Structure according to claim 1 wherein said flap has a tough nylon cloth backing on the side of said foam remote from said tafeta.

3. A combination wallet and badge holder comprising:

(a) a generally rectangular flexible back panel;

(b) a flexible front panel fastened to said back panel along at least two contiguous edges thereof to define a bill compartment:

(c) a badge-mounting panel mounted to at least one of the above stated panels;

(d) a badge cover flap mounted to at least one of the above mentioned panels to removably protect and conceal a badge mounted on said badge-mounting panel; and (e) said badge-mounting panel having a plurality of aligned eyelets therein for inserting the pin from a badge without damaging the panel.

4. A combination wallet and badge holder comprising:

(a) a generally rectangular flexible back panel;

(b) a flexible front panel fastened to said back panel along at least two contiguous edges thereof to define a bill compartment;

(c) a badge-mounting panel mounted to at least one of the above stated panels;

(d) a badge cover flap mounted to at least one of the above-mentioned panels to removably protect and conceal a badge mounted on said badge-mounting panel; and (e) said flap being stitched along one edge thereof to said badge-mounting panel to define a hinge and said flap has side edges that taper inwardly toward said hinge to define a hinge of reduced length.

* * * * *